US005647096A

United States Patent [19]

Chang

[11] Patent Number: 5,647,096

[45] Date of Patent: Jul. 15, 1997

[54] RETRACTABLE HANDLE CONTROL MECHANISM

[76] Inventor: Chi-bin Chang, P.O. Box 82-144, Taipei, Taiwan

[21] Appl. No.: 547,287

[22] Filed: Oct. 24, 1995

[51] Int. Cl.[6] ..... B25G 1/04

[52] U.S. Cl. ..... 16/115; 280/655; 190/14; 190/18 R

[58] Field of Search ..... 16/115; 280/47.371, 280/47.315, 655, 655.1; 190/14, 15 R, 18 R, 18 A

[56] References Cited

U.S. PATENT DOCUMENTS

| | | | |
|---|---|---|---|
| 3,572,870 | 3/1971 | Marks | 16/115 |
| 4,974,871 | 12/1990 | Mao | 280/47.371 |
| 5,438,731 | 8/1995 | Kazmark, Jr. | 16/115 |
| 5,499,426 | 3/1996 | Hsieh | 16/115 |

*Primary Examiner*—Chuck Y. Mah
*Attorney, Agent, or Firm*—Alfred Lei

[57] ABSTRACT

A retractable handle control mechanism including a movable control block mounted in a longitudinal hole on the transverse handgrip of the retractable handle and moved by a control knob, two beveled edged links connected between the beveled guide blocks of two release control rods, which are moved in the inner tubes, and the two opposite bevel edges of the movable control block, and return control spring means, whereby when the control knob is depressed to lower the movable control block, the links are moved outwards in reversed directions to force the bevel guide blocks of the release control rods downwards, causing the release control rods to release the respective latches from the sleeves for permitting the inner tubes to be moved by the transverse handgrip between the retracted position and the extended position.

6 Claims, 4 Drawing Sheets

RETRACTABLE HANDLE CONTROL MECHANISM

BACKGROUND OF THE INVENTION

This invention relates to retractable handles, and relates more particularly to a retractable handle control mechanism for release control of a retractable handle.

A bag truck is generally equipped with a retractable handle for steering control. This retractable handle is comprised of two sleeves fixedly fastened to the frame of the bag truck, two inner tubes joined by a transverse handgrip outside the sleeves and moved between the retracted position and the extended position, lock means for locking the inner tubes in the retracted position of the extended position, and control mechanism for unlocking the lock means for permitting the inner tubes to be moved between the retracted position and the extended position. FIG. 5 shows a retractable handle control mechanism according to the prior art. As illustrated, the mounting frame 31 which holds the sleeves 30 of the retractable handle, has an inside space, which receives two locating rods 33 and a traction cable 32 connected between the locating rods 33. The locating rods 33 are supported on a respective spring 34. The spring 34 forces the respective locating rod 33 into a respective locating hole on the respective sleeve 30 and a respective locating hole on the respective inner tube 35. A pedal 37 is installed in the frame of the bag truck and connected to the traction cable 32 by a spring link 36. When the pedal 37 is depressed, the traction cable 32 is driven by the spring link 36 to pull the locating rods 33 inwards from the locating holes of the inner tubes 35, and therefore the inner tubes 35 can be moved between the retracted position and the extended position. This structure of retractable handle control mechanism still has drawbacks. Because the spring link 36 is disposed on the outside, it tends to be damaged. Another drawback of this structure of retractable handle control mechanism is that the bag truck must be put in the standing position so that the pedal 37 can be conveniently operated by foot. Still another drawback of this structure of retractable handle is that the spring power of the spring link 36 will become weak with use. If the spring link 36 looses its spring power, it cannot be driven to pull the traction cable 32 effectively.

SUMMARY OF THE INVENTION

This invention has been accomplished to provide a retractable handle control mechanism which eliminates the aforesaid drawbacks. The retractable handle control mechanism of the present invention is for release control of a retractable handle consisting of a transverse handgrip having two downward plug holes at two opposite ends, two sleeves, and two inner tubes fixedly secured to the downward plug holes of the transverse handgrip and moved in the sleeves between retracted position and extended position, the control mechanism comprising a longitudinal hole made on the transverse handgrip in communication with the downward plug holes, a top hole made on the transverse handgrip and perpendicularly connected to the longitudinal hole between the downward plug holes, two links mounted in the longitudinal holes, each link having a first bevel edge and a second bevel edge at two opposite ends, a locating rod vertically mounted inside the longitudinal hole and aligned with the top hole, a movable control block disposed inside the longitudinal hole and stopped between the links and moved vertically along the locating rod between an upper limit position and a lower limit position inside inside the longitudinal hole, the movable control block having two bevel edges at two opposite ends respectively matched with the first bevel edges of the links, a control knob fixed to the movable control block and extended out of the top hole, a first spring means connected between the control knob and the locating rod to force the control knob upwards for permitting the movable control knob to be retained in the upper limit position, two release control rods respectively moved in the inner tubes and controlled to force a respective latch from the sleeves for permitting the inner tubes to be moved between the retracted position and the extended position, each release control rod having a top end extended out of the respective inner tube and fixedly mounted with a bevel guide block, which matches with the second bevel edge of one link, and two second spring means respectively mounted around the release control rods of the inner tubes and stopped between the inner tubes and the bevel guide blocks of the release control rods, whereby when the control knob is depressed to lower the movable control block from the upper limit position to the lower limit position, the links are moved outwards in reversed directions to force the bevel guide blocks of the release control rods of the inner tubes downwards, causing the release control rods to release the respective latches from the sleeves for permitting the inner tubes to be moved between the retracted position and the extended position.

DETAILED DESCRIPTION OF THE PREFERRED EMBODIMENT

Figure 1:
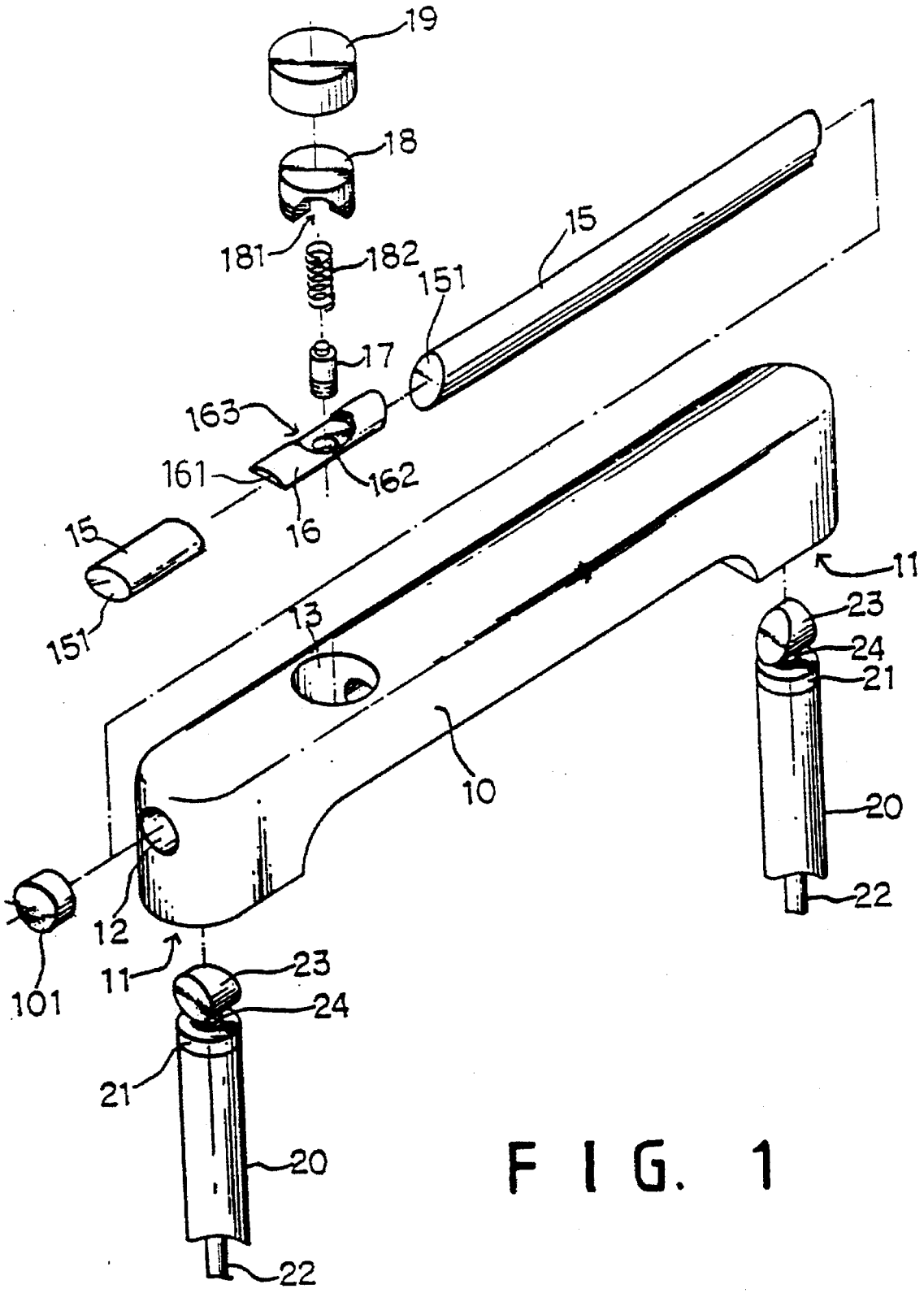
FIG. 1 is an exploded view of a retractable handle control mechanism according to the present invention.
Figure 2:
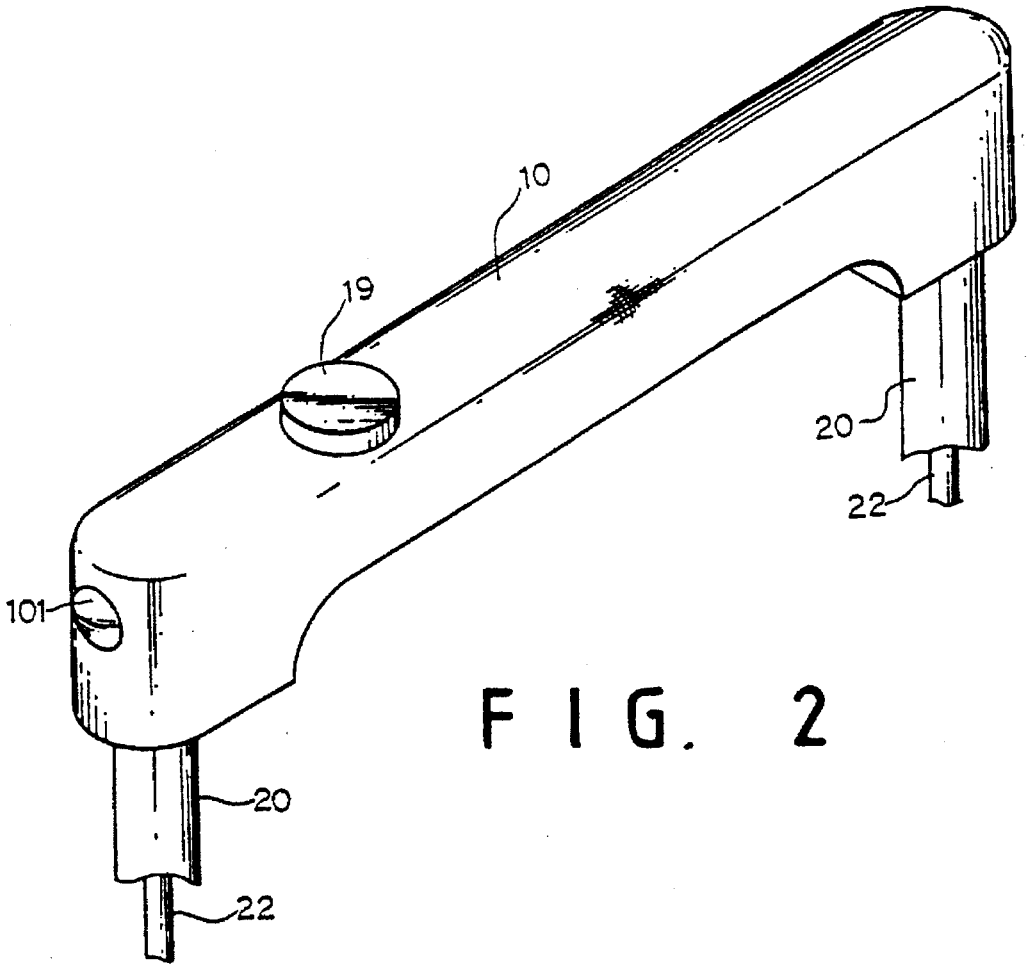
FIG. 2 is an elevational view of the retractable handle control mechanism shown in FIG. 1.
Figure 3:
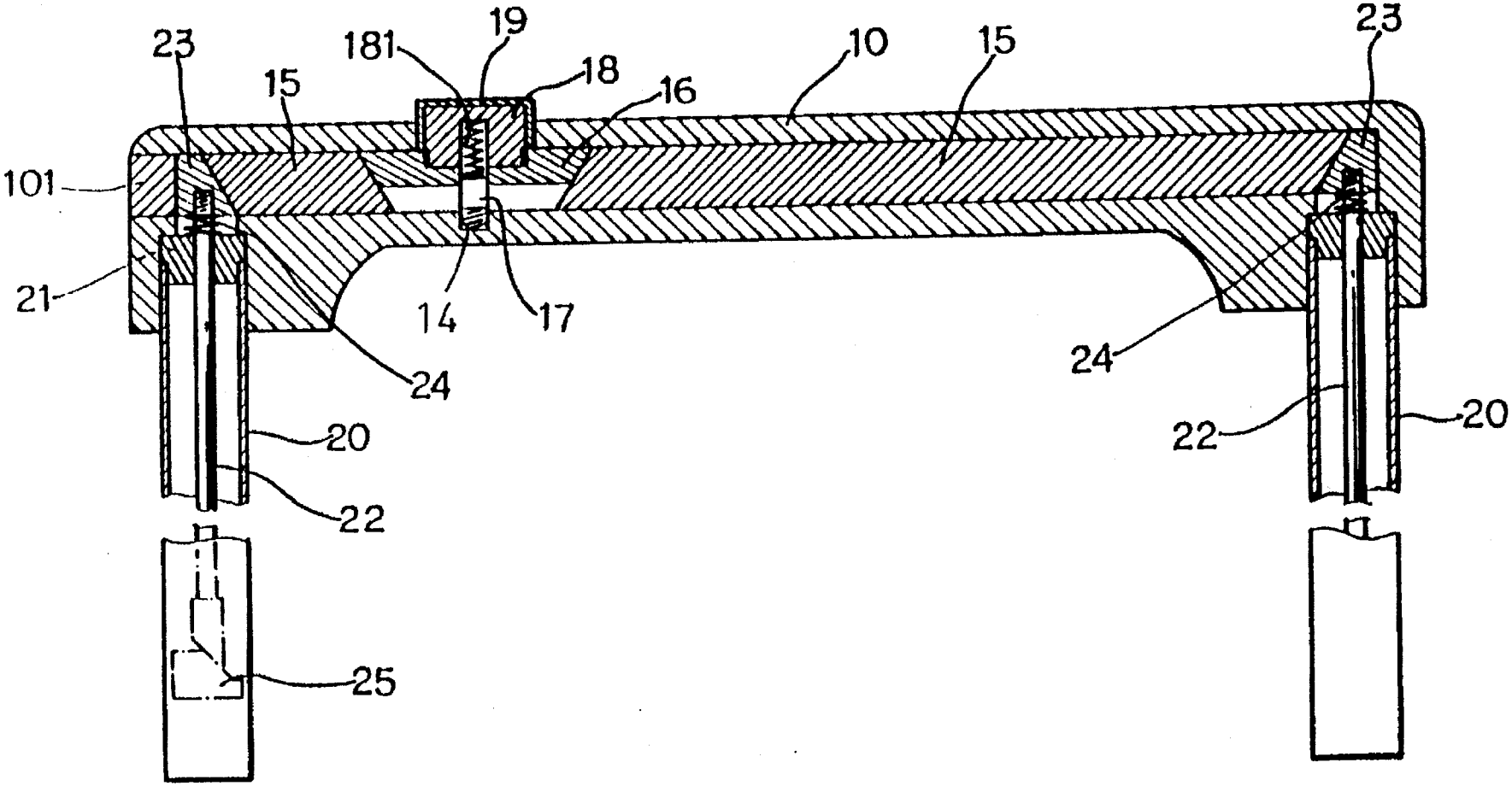
FIG. 3 is a sectional view of the retractable handle control mechanism shown in FIG. 1 when not depressed.
Figure 5:
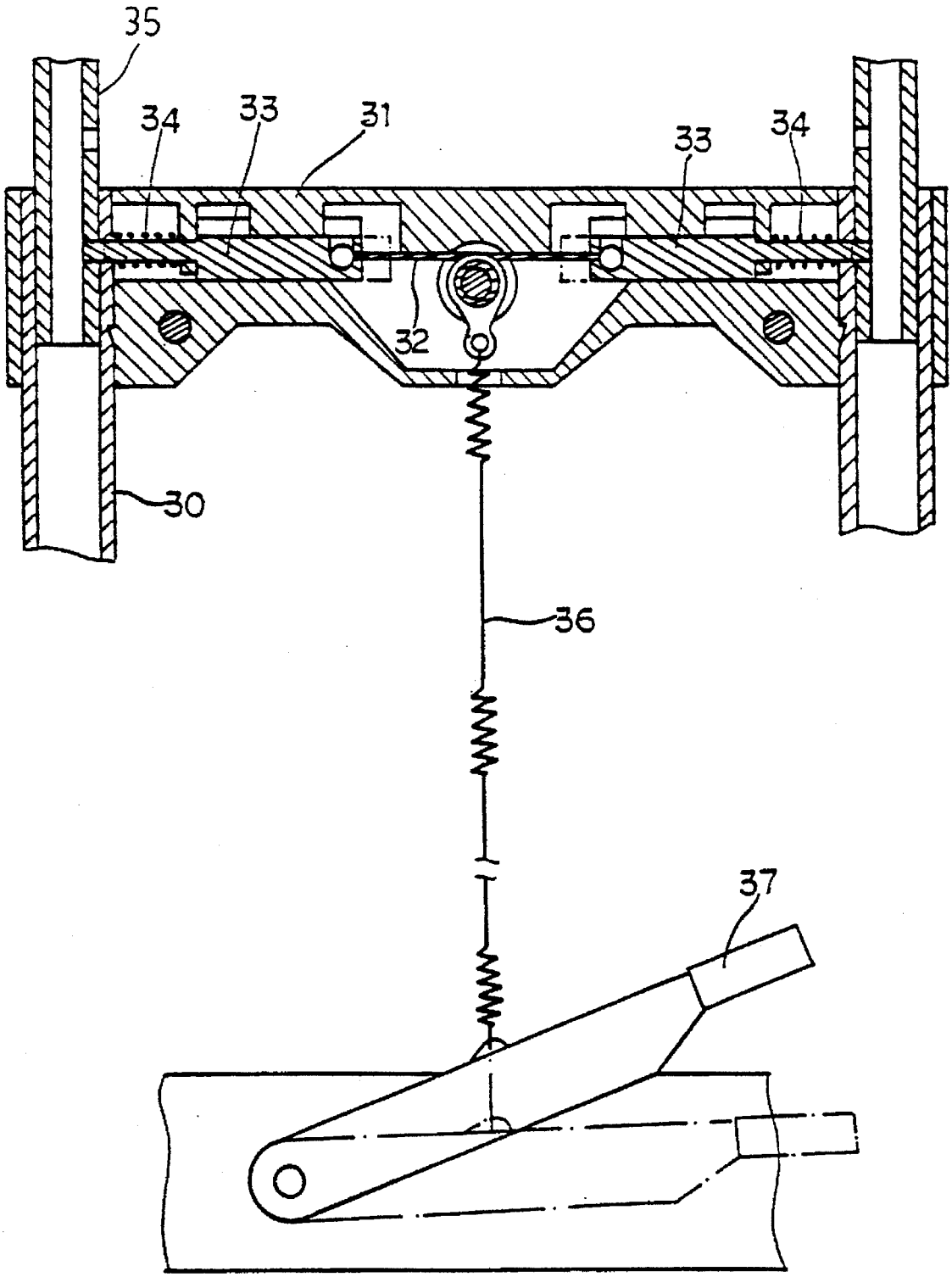
PRIOR ART FIG. 5
FIG. 5 shows a retractable handle control mechanism according to the prior art.

Referring to FIGS. 1, 2, and 3, the transverse handgrip, referenced by 10, comprises a longitudinal blind hole 12 covered with a cap 101, two downward plug holes 11 vertically disposed at two opposite ends and perpendicularly connected to the longitudinal blind hole 12 for receiving two inner tubes 20 (that slide in two sleeves), a top hole 13 perpendicularly connected to the longitudinal blind hole 12 between the downward plug holes 11, and a threaded recessed hole 14 on the inside of the longitudinal blind hole 12 and vertically aligned with the top hole 13. Two cylindrical links 15 are mounted inside the longitudinal blind hole 12. Each of the cylindrical links 15 has two beveled edges 151 at two opposite ends. A movable, cylindrical control block 16 is mounted inside the longitudinal blind hole 12 and connected between the cylindrical links 15. The movable cylindrical control block 16 comprises a threaded recessed hole 163 at the center, two beveled edges 161 at two opposite ends respectively abutted against the respective bevel edges 151 of the cylindrical links 15, a center through hole 162 at the center of the threaded recessed hole 163. The diameter of the movable cylindrical control block 16 is about ½ of that of the cylindrical links 15. A locating screw rod 17 is inserted through the center through hole 162 and threaded into the threaded recessed hole 14. The diameter of the center through hole 162 is bigger than the diameter of the locating screw rod 17 so that the movable cylindrical control block 16 can be moved vertically along the locating screw rod 17. An externally threaded control knob 18 is mounted in the top hole 13 of the transverse handgrip 10 and threaded into the threaded recessed hole 163 of the movable cylindrical control block 16. A spring 182 is mounted in the bottom hole 181 on the externally threaded control knob 18 and connected between the externally threaded control knob 18 and the locating screw rod 17. An ornamental cap 19 is covered on the externally threaded control knob 18. When the externally threaded control knob 18 is installed and covered with the ornamental cap 19, the ornamental cap 19 is disposed outside the top hole 13 of the transverse handgrip 10, and the movable cylindrical control block 16 is disposed at an upper limit position (see FIG. 3). Each of the inner tubes 20 has a respective top end cap 21 at the top fixedly secured to one downward plug hole 11 of the transverse handgrip 10, and a longitudinal release control rod 22. The longitudinal release control rod 22 has a top end extended out of a hole (not shown) on the top end cap 21 and fixedly mounted with a bevel guide block 23, which matches with one bevel edge 151 of the respective link 15. A spring 24 is mounted around the release control rod 22 of each inner tube 20 and stopped between the respective top end cap 21 and the respective bevel guide block 23.

Figure 4:
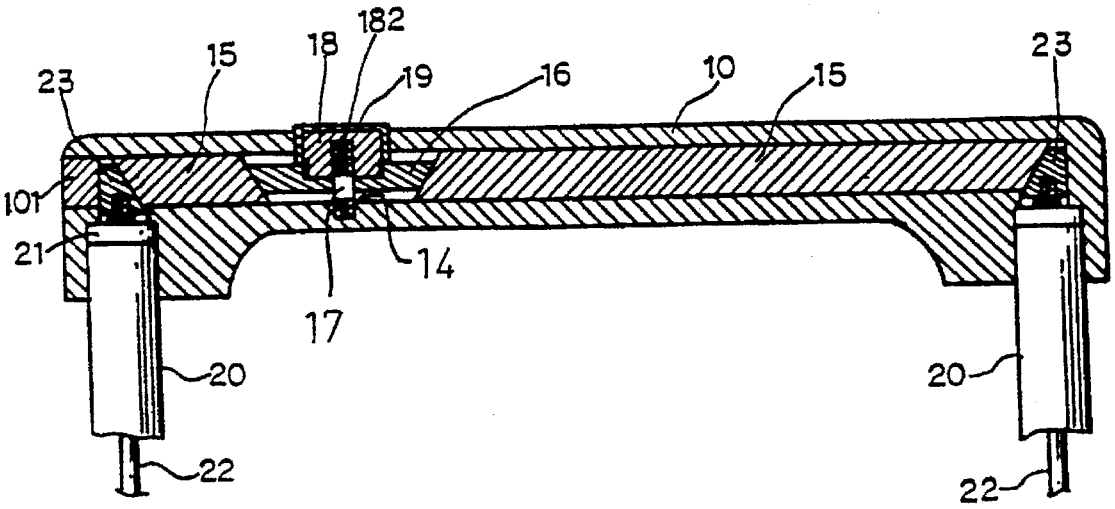
FIG. 4 is similar to FIG. 3 but showing the control knob depressed, and the movable cylindrical control block moved from the upper limit position to the lower limit position.

Referring to FIG. 4 and FIG. 3 again, when the ornamental cap 19 is depressed, the movable cylindrical control block 16 is forced downwards from the upper limit position (see FIG. 3) to a lower limit position (see FIG. 4) to force the links 15 bilaterally outwards. When the links 15 are forced outwards in reversed directions, the bevel guide blocks 23 of the inner tubes 20 are forced downwards to compress the springs 24 respectively. When the bevel guide blocks 23 are forced downwards, the release control rods 22 are lowered to release the respective latches 25 from the sleeves (not shown), and therefore the inner tubes 20 can be pulled out of the sleeves by the transverse handgrip 10. When the ornamental cap 19 is released, the spring 182 automatically pushes the control knob 18 back to its former position, and therefore the movable cylindrical control block 16 is moved from the lower limit position (see FIG. 4) to the upper limit position (see FIG. 3).

It is to be understood that the drawings are designed for purposes of illustration only, and are not intended as a definition of the limits and scope of the invention disclosed. For example, the longitudinal blind hole 12 can be made having a rounded, square, or rectangular cross section, and the links 15 are made fitting the cross section of the longitudinal blind hole 12.

I claim:

1. A retractable handle control mechanism for release control of a retractable handle consisting of a transverse handgrip having two downward plug holes at two opposite ends, two sleeves, and two inner tubes fixedly secured to the downward plug holes of said transverse handgrip and movable in said sleeves between retracted position and extended position, a longitudinal hole made on said transverse handgrip in communication with said downward plug holes, a top hole made on said transverse handgrip and perpendicularly connected to said longitudinal hole between said downward plug holes, two links mounted in said longitudinal holes, each link having a first bevel edge and a second bevel edge at two opposite ends, a locating rod vertically mounted inside said longitudinal hole and aligned with said top hole, a movable control block disposed inside said longitudinal hole and stopped between said links and moved vertically along said locating rod between an upper limit position and a lower limit position inside said longitudinal hole, said movable control block having two bevel edges at two opposite ends respectively matched with the first bevel edges of said links, a control knob fixed to said movable control block and extended out of said top hole, a first spring means connected between said control knob and said locating rod to force said control knob upwards for permitting said movable control knob to be retained in said upper limit position, two release control rods respectively movable in said inner tubes and controlled to force a respective latch from said sleeves for permitting said inner tubes to be moved between said retracted position and said extended position, each release control rod having a top end extended out of the respective inner tube and fixedly mounted with a bevel guide block, which matches with the second bevel edge of one link, and two second spring means respectively mounted around the release control rods of said inner tubes and stopped between said inner tubes and the bevel guide blocks of said release control rods, whereby when said control knob is depressed to lower said movable control block from said upper limit position to said lower limit position, said links are moved outwards in reversed directions to force the bevel guide blocks of said release control rods of said inner tubes downwards, causing said release control rods to release the respective latches from said sleeves for permitting said inner tubes to be moved between said retracted position and said extended position.

2. The retractable handle control mechanism of claim 1 wherein said control knob is covered with an ornamental cap.

3. The retractable handle control mechanism of claim 1 wherein said longitudinal hole has a rounded cross section; each of said links has a rounded cross section movable in the longitudinal hole.

4. The retractable handle control mechanism of claim 1 wherein said longitudinal hole has a rectangular cross section; each of said links has a rectangular cross section movable in the longitudinal hole.

5. The retractable handle control mechanism of claim 1 wherein said movable control block has a recessed hole at the center connected to said control knob, and a center through hole at the center of said recessed hole for passing said locating rod.

6. The retractable handle control mechanism of claim 1 wherein said longitudinal hole is made through two opposite ends of said transverse handgrip and covered with a respective cap.

* * * * *